US006354236B1

(12) United States Patent
Davidson

(10) Patent No.: US 6,354,236 B1
(45) **Date of Patent: *Mar. 12, 2002**

(54) AERODYNAMIC AND HYDRODYNAMIC ALUMINUM BOAT HULL WITH TRIANGULAR FLAT PAD

(75) Inventor: Samuel L. Davidson, Monroe, LA (US)

(73) Assignee: Duracraft Marine Corporation, Delhi, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/708,073

(22) Filed: Nov. 8, 2000

Related U.S. Application Data

(63) Continuation-in-part of application No. 09/245,904, filed on Feb. 8, 1999, now Pat. No. 6,173,670.

(51) Int. Cl.[7] ..... B63B 1/00
(52) U.S. Cl. ..... 114/271; 114/356
(58) Field of Search ..... 114/255, 356, 114/357, 358, 359, 364, 271, 56.1

(56) References Cited

U.S. PATENT DOCUMENTS 3,032,785 A * 5/1962 Ward et al. ..... 114/356
4,813,365 A * 3/1989 Lindstrom et al. ..... 114/352
5,279,249 A * 1/1994 Pepper ..... 114/356
5,322,030 A * 6/1994 Brehmer ..... 114/343
5,390,624 A * 2/1995 Barnes ..... 114/288
5,676,080 A * 10/1997 Allen ..... 114/356
5,685,253 A * 11/1997 Alexander ..... 114/271
6,173,670 B1 * 1/2001 Davidson ..... 114/271

OTHER PUBLICATIONS

Xpress, Since 1965 the Original All Welded Boat, 1998.

Dura Craft, Value Engineered for a Lifetime.

Sea Ark Boats, Aluminum Jon Boats, Super Jons, Fishing Boats & Deck Style Boats.

Crestliner, the Leader by Innovation.

* cited by examiner

*Primary Examiner*—Jesus D. Sotelo
(74) *Attorney, Agent, or Firm*—Jacobson Holman, PLLC

(57) ABSTRACT

A performance aluminum vee boat hull with a concave bow section, elongated, parallel strakes, a central keel and a triangular shaped, substantially flat pad adjacent the transom and between the innermost strakes that increases the top speed of the boat and adapts the same to easily handle 150–200 horsepower engines.

8 Claims, 3 Drawing Sheets

AERODYNAMIC AND HYDRODYNAMIC ALUMINUM BOAT HULL WITH TRIANGULAR FLAT PAD

RELATED APPLICATION

This application is a continuation-in-part of application Ser. No. 09/245,904 filed Feb. 8, 1999, now U.S. Pat. No. 6,173,670, the disclosure of which, in its entirety, is incorporated herein by reference.

FIELD OF THE INVENTION

The present invention relates to the field of aluminum boat hulls, and in particular to aluminum boat hulls configured to maximize stability and speed.

BACKGROUND OF THE INVENTION

Concave bows, keels, strakes that extend longitudinally, off-sets or jack plates, and vee shaped hulls are not new to boats intended to be powered by outboard engines. However, each of these items is used in a separate, particular way.

For example, providing a keel on a boat is known to increase its tracking ability, but it is also known to provide drag and generally is considered to decrease speed. Therefore, few "performance" or high speed boats have keels.

Strakes are normally used for two reasons, namely to increase the strength of a boat bottom, and when disposed with one strake surface parallel to the water surface, to give lift. In aluminum boats, in particular, strakes are generally tapered at the rear end so that they do not prevent bow lift, or if not tapered at the rear end, then the transom is formed with a tapered corner to insure some lift, but this increases so called "draft".

"Set-backs" are somewhat common for performance bass boats with so-called pad hulls. Pad hulls have narrow (8–14 inches), centrally located, longitudinal bottom surfaces that are substantially flat (i.e. flat or only slightly "veed" or concaved) as part of a configuration with multiple stepped flat surfaces running all or most of the length of the hull. The central flats in such hulls generally extend at least 6 feet or more forward of the stern, effectively forming the bottom step in a stepped hull. While such flats provide a minimum water contact surface area to enhance the boat speed, the length of such flattened bottom surfaces in a stepped hull tends to interfere with other performance characteristics in boat hulls having this configuration.

Vee hulls are common in outboard motor boats because they are known for their softer ride and "rough water" abilities. However, except for boats incorporating my inventive concepts, aluminum vee shaped hulls with performance characteristics that approach fiberglass, are not known to the outboard motor boat market.

The high speed (rather than custom hand crafted) production of a performance vee hull heretofore generally relied on molded fiberglass or sophisticated aluminum "stretch forming" techniques. Molding of a hull with fiberglass is a manual operation including applying layers of fiberglass into a mold of any desired configuration and such application takes extended periods of time and presents numerous environmental problems. Stretch forming limits elongated variations such as strake length and causes thick and thin spots.

Thus, the conventional wisdom recognized that keels provide drag, strakes either are tapered at the back or the hull has "cut corners", jack-plates on vee hulls commonly sit far back (not 4–8 inches), concave bows are for pad boats (not for severe 15 degrees or more vees), and normal aluminum production techniques are not suited to economically provide a performance vee. The ability to provide a high speed, stable, aluminum boat hull, adapted for reception of an outboard motor, using less expensive production techniques was sought by those skilled in the art without success until the development of the hull described herein having a concave bow, elongated parallel strakes, a central keel, an offset motor mount and a deep vee configuration extending over a major portion of the length of the hull. Yet, to maintain the stability and handling afforded by this configuration while increasing the speed would even further enhance the commercial attractiveness of such a design.

SUMMARY OF THE INVENTION

It is therefore an object of the present invention to provide a performance vee shaped hull that can be made with conventional aluminum manufacturing techniques on a relatively economical basis, using the lift of a concave bow, the off-setting "hold down" of strakes, the tracking and drag of a keel and, preferably, an integrally formed, limited, off-set motor mount, modified by incorporating a relatively short, triangular, substantially flat pad at the stern between the innermost strakes to provide increased lift at high speeds without detracting from the remaining high performance properties of this hull design.

The hull of the present invention can be used in a so-called "bass boat" arrangement or a "bay boat" arrangement. In a standard 19 foot long configuration, with a 66 inch wide bottom, the boat hull of the present invention, even without the triangular pad, can run between 53 and 60 miles per hour when powered by a stock 115 horsepower engine, and will handle turns and rough water beyond expectations. When the triangular pad is added to the hull bottom, the speed can be increased without damaging the handling characteristics of such a hull. This design adapts the boat to easily handle 150 to 200 horsepower engines, bringing the top speeds into competitive range. Thus, the substantially flat triangular pad provides lift, increasing speed, while the central strakes act as stabilizers on either side of the pad and the deep vee hull tends to cut through the waves when the boat is running slow.

In its preferred configuration, it is an object of the present invention to provide a vee shaped aluminum hull having a central keel, with strakes extending from the bow to the stern of the hull, a set back section for supporting an outboard motor, and a triangular flat pad of limited length intermediate the innermost strakes at the stern of the boat.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
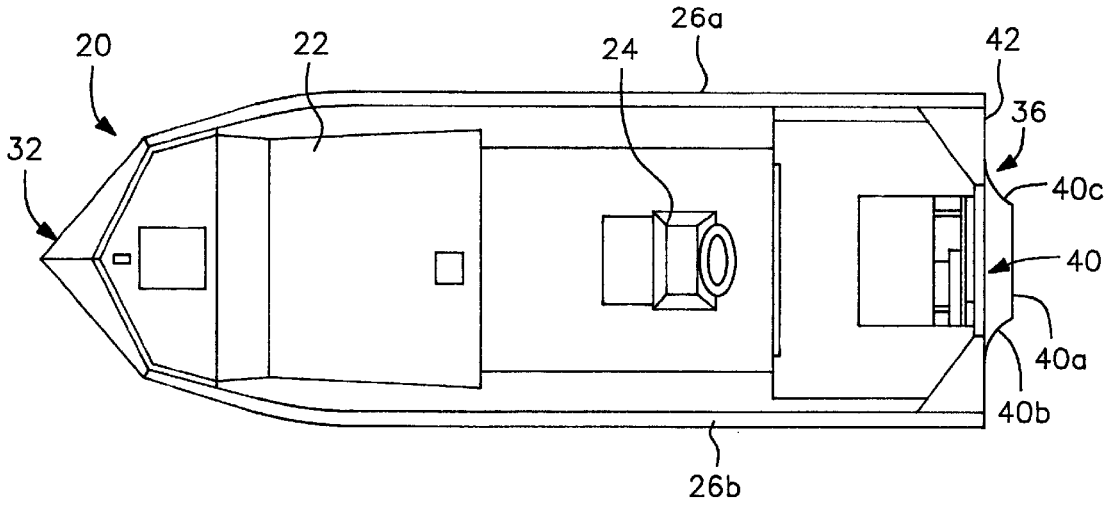
FIG. 1 is a plan view of a bay-type boat incorporating the preferred hull design of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, a bay-type boat embodying the teachings of the present invention is generally designated at 20. It is to be understood that the instant inventive concepts are equally applicable to a bass-type boat (not shown), the configuration of which is substantially the same, although the bass-type boat is generally of lesser height and has a different interior design adapted primarily to the type of fishing contemplated. Yet, for all intents and purposes, the hull configuration of this invention may be incorporated into aluminum boats for enhanced performance, regardless of the anticipated use.

Figure 2:
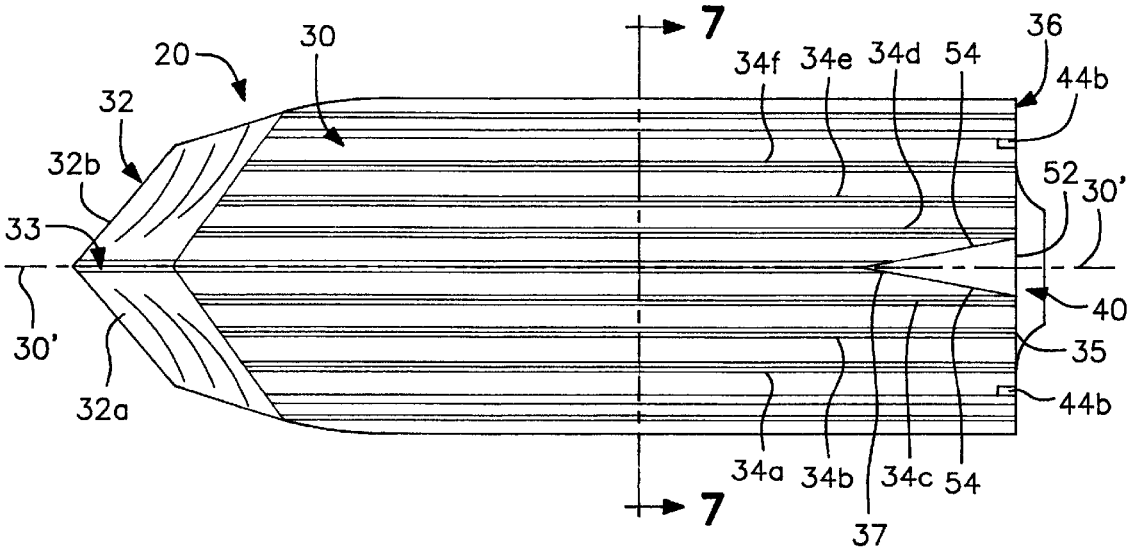
FIG. 2 is a bottom plan view of the boat of FIG. 1 illustrating a plurality of longitudinally extending, parallel strakes, a set back section for mounting an outboard engine to propel the boat, and a triangular flat pad between the innermost strakes at the stern of the boat.
Figure 3:
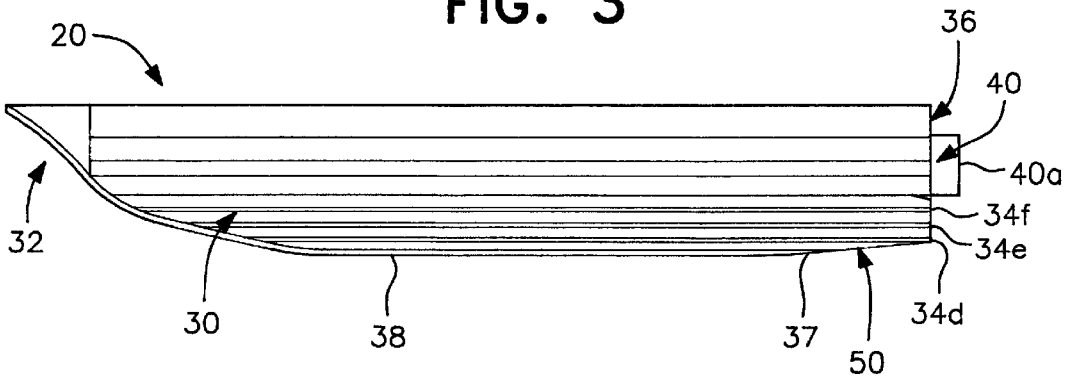
FIG. 3 is a side view of the boat of FIG. 1.

With reference, however, to the bay-type configuration illustrated in FIG. 1, the boat includes an upper deck 22 including a steering console mechanism 24 and gunwales 26*a*, 26*b*. As shown in FIGS. 2 and 3, on the underside of the boat 20 is the hull 30 incorporating the inventive principles of the present invention. At the bow 32 there are concave or reversely curved sections 32*a*, 32*b* carried by a bow extrusion 33. Extending rearwardly from the bow 32 are a plurality of parallel strakes spaced on either side of the longitudinally extending central axis 30' of the hull 30, six such strakes 34*a* through 34*f* being shown for illustrative purposes. The strakes 32*a*–32*f* extend from a collapsed forward edge in a constant cross-sectional configuration to a rear edge 35 located at the stern 36 of the boat.

Extending rearwardly and centrally from the bow extrusion 33 along the central longitudinal axis 30*a* of the hull 30 is a keel 38 which, in the preferred embodiment of this invention, terminates at a point 37 forward of the stern 36.

Figure 5:
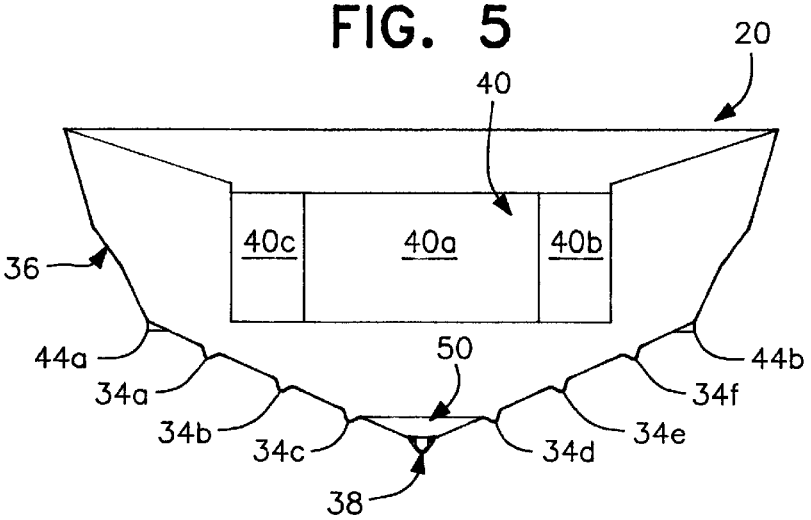
FIG. 5 is a rear view of the boat of FIG. 1.

A set back section 40 extending beyond the transom 42 for mounting of an outboard engine (not shown) is preferably provided on the stern 36, including a flat section 40*a* which extends parallel to the transom of the boat. The flat section of the set back can be secured to the transom in any desired manner such as by welded channels (not shown). Two concave curved sections 40*b* and 40*c*, as shown in FIGS. 1, 2 and 5, cover the connection between the flat section 40 and the transom 42 of the boat to provide for a cosmetically attractive installation.

Figure 4:
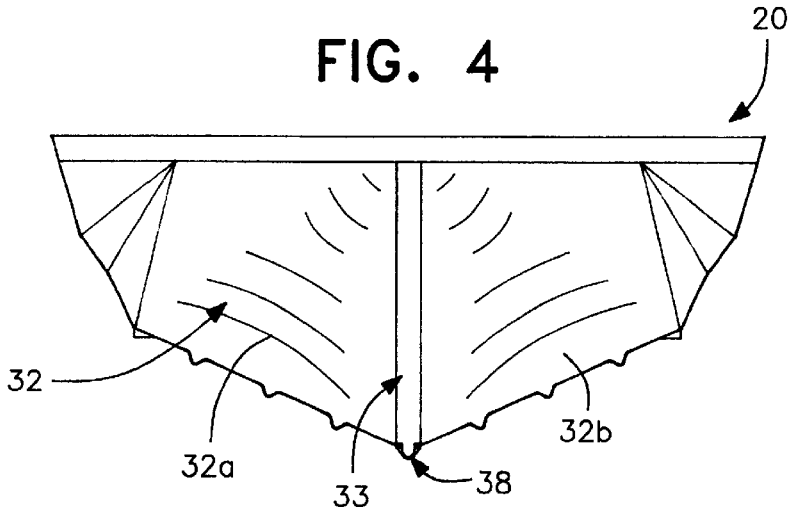
FIG. 4 is a front view of the boat of FIG. 1 showing the bow.
Figure 6:
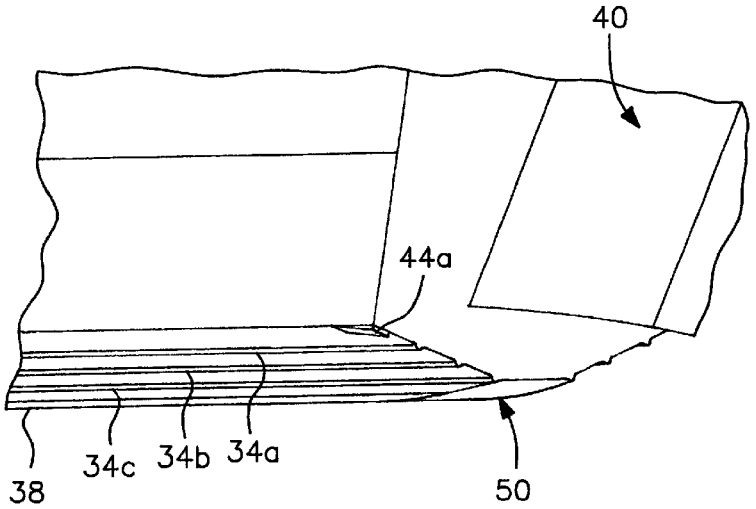
FIG. 6 is a fragmentary perspective view of the boat of FIG. 1.

As shown in FIGS. 2, 4 and 6, wedge shaped lips 44*a*, 44*b* are added to the bottom of the hull at two locations adjacent the rear edge 37 of the hull. The height of the wedges preferably increase in a direction from the bow to the stern, and from chine to keel as well. The lips minimize any bow lift during initial application of power from an outboard engine mounted on the set back section 40, and then, when the boat is under power, these lips have minimal or no contact with the water. If deep lips are used, the rear end of the strakes can be collapsed.

Figure 7:
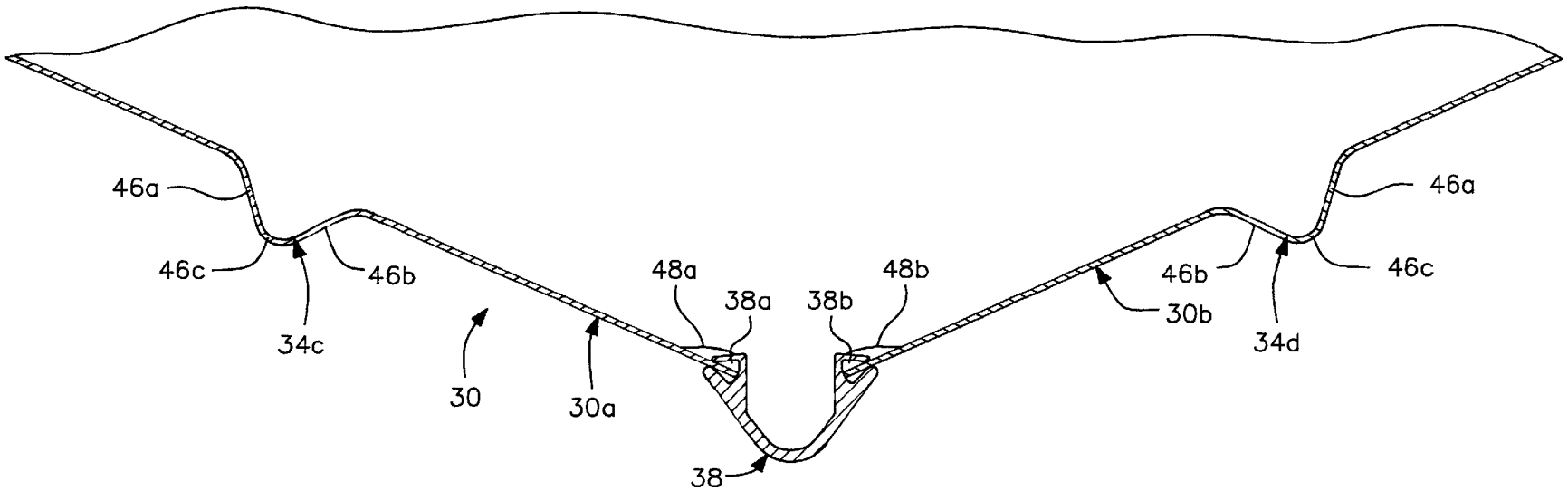
FIG. 7 is an enlarged fragmentary transverse cross-section through the hull taken along lines 7—7 of FIG. 2.

Strakes 34*c* and 34*d* are shown in more detail in FIG. 7. These strakes are representative of all of the strakes on the hull. Each strake includes side walls 46*a*, 46*b* intersecting to form a U-shaped intersection 46*c*. In an alternative embodiment (not shown), intersection 46*c* may be vee shaped or may have any other configuration.

The hull 30 is made up of two aluminum sections 30*a*, 30*b* extending at an angle to the horizontal and held in place in the keel 38 in a conventional manner within openings 38*a*, 38*b*, respectively, such as by welds 48*a*, 48*b* located on the interior of the hull 30.

An important improvement in the hull of the instant invention is the addition of the small triangular substantially flat pad 50 in between the innermost strakes 34*c* and 34*d* and extending forwardly of the stern 36 of the boat. The triangular pad 50 includes a base 52 extending tranversely to the central axis 30' at the transom 42 and a pair of sides 54, 54 extending forwardly and inwardly from the ends of the base 52 to converge at an apex at the point 37 where the pad 50 meets the keel 38. The pad 50 may be secured to the sides 30*a*, 30*b* of the hull and to the end of the keel 38 in any conventional manner such as by welds (not shown).

The dimensions of the pad 50 obviously depend on the size of the hull. However, it is important that the base 52 extends between the innermost strakes 34*c* and 34*d*, preferably terminating at the strakes 34*c*, 34*d*, for increased lift and speed without interfering with the improved stability and handling characteristics afforded by the strakes. For most applications, the width of the base 52 should be on the order of about 10" to 14".

The height "h" of the triangular pad 50 along the central axis 30' of the hull 30 from the base 52 to the apex of the triangle at the point 37 is very limited in contrast to the extended flattened bottom surfaces or long "pad" found in prior art stepped hull designs. For example, in a hull of approximately 19' in length, the height "h" of the pad 50 can be from approximately 30" to about 4', or from about 10 percent to about 25 percent of the length of the hull, preferably from about 15 percent to about 25 percent.

Although, as noted, some leeway exists, the preferred pad has a base 52 width of about 10" and a height "h" of about 33". Such a configuration provides increased lift and maximum speed when the boat is moving fast and the bow of the boat is lifted out of the water without reducing the stabilizing effect of the strakes which tend to keep the boat straight to, thereby, facilitate handling. The limited extent of the triangular flat pad does not interfere with the smooth ride afforded by the vee shaped hull which still extends over the major portion of the length of the hull.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. In a boat for use with an outboard motor including an aluminum hull defining a longitudinally extending central axis extending from a concave bow section at the front of the hull to a transom at the rear of the hull, wherein the hull includes two sections secured to a keel that extends along the central axis to define a substantially constant vee shaped cross-section along at least a major portion of the length of the hull, each of the hull sections including a plurality of strakes generally parallel to, and spaced from, each other and from the central axis and extending from the rear of the hull toward the bow section, the improvement which comprises:

a substantially flat, generally triangular pad at the rear of said hull positioned between the innermost of said strakes on each side of said central axis, said pad including a base extending transversely to said central axis at about said transom, and a pair of sides extending forwarding and inwardly from the ends of said base and converging at an apex on said central axis, the height of said pad along said central axis between said base and said apex being from about 10 percent to about 25 percent of the length of said hull.

2. The improvement of claim 1 wherein said height of said pad is from about 15 percent to about 25 percent of the length of said hull.

3. The improvement of claim 1 wherein said base extends to said innermost of said strakes.

4. The improvement of claim 1 further including a set back section extending rearwardly from said transom for supporting an outboard motor.

5. The improvement of claim 1, further including a wedge on each side of, and adjacent to, the rear edge of said hull.

6. The improvement of claim 1, wherein said hull sections are welded to said keel and said pad is welded to said hull sections.

7. The improvement of claim 1, wherein said bow section includes two concave curved portions located on opposite sides of said keel.

8. The improvement of claim 1, wherein said strakes have a constant cross-section from adjacent to said bow section to the rear edge of said hull.

* * * * *